United States Patent [19]

Enchelmaier

[11] 4,126,358

[45] Nov. 21, 1978

[54] METHOD AND APPARATUS FOR MAKING WOUND BRUSHES

[76] Inventor: Harvard W. K. Enchelmaier, 4 E. Greenbrook Rd., North Caldwell, N.J. 07006

[21] Appl. No.: 851,287

[22] Filed: Nov. 14, 1977

Related U.S. Application Data

[62] Division of Ser. No. 736,483, Oct. 28, 1976.

[51] Int. Cl.[2] ..... A46D 3/04

[52] U.S. Cl. ..... 300/21; 300/2

[58] Field of Search ..... 300/1, 2, 4, 21

[56] References Cited

U.S. PATENT DOCUMENTS

| | | | |
|---|---|---|---|
| 1,950,379 | 3/1934 | Angell | 300/21 |
| 2,701,739 | 2/1955 | Enchelmaier | 300/2 |
| 2,756,109 | 7/1956 | Nelson et al. | 300/2 |
| 3,246,931 | 4/1966 | Enchelmaier et al. | 300/2 |
| 3,633,974 | 1/1972 | Lewis, Jr. | 300/21 |

*Primary Examiner*—Granville Y. Custer, Jr.

[57] ABSTRACT

Method and apparatus for making a wound rope or cord bound brush. The method and apparatus of the invention makes it possible to vary the angle at which the brush bristles project from the surface of the brush core (a) in either direction tangentially of the brush core with respect to a longitudinal axial plane thereof, and/or (b) the angle of the bristles longitudinally of the brush with respect to transverse planes through the axis of the brush.

17 Claims, 20 Drawing Figures

117
142
30, 31
134
136
132
129
104
102
127
135
139
120
122
141
121
140
11
21
70
108
106
101
105
71
19
21
41
26
20
22

Fig. 4
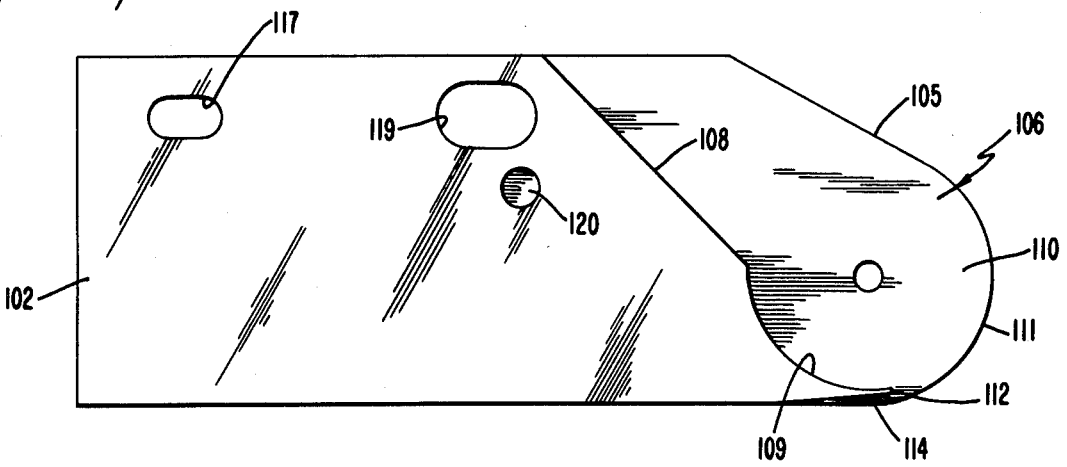
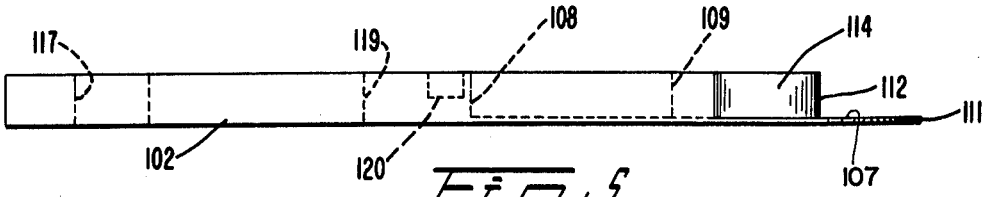
Fig. 5
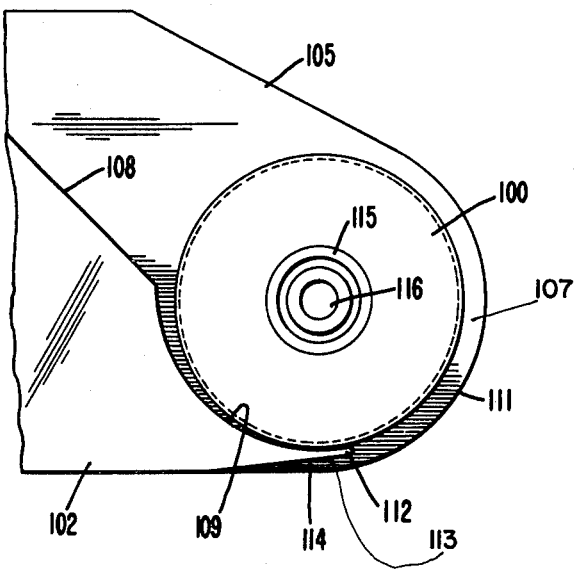
Fig. 6
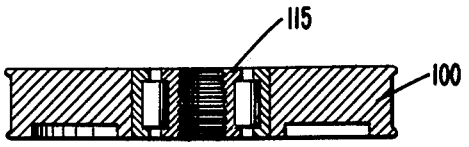
Fig. 7

Fig. 10a
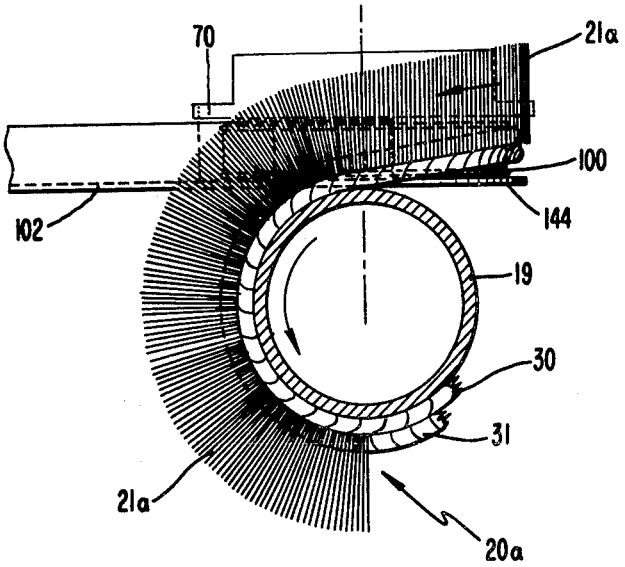
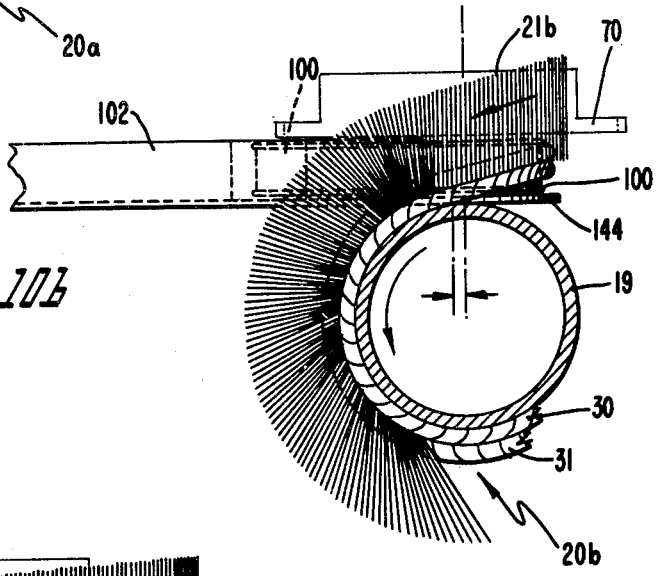
Fig. 10b
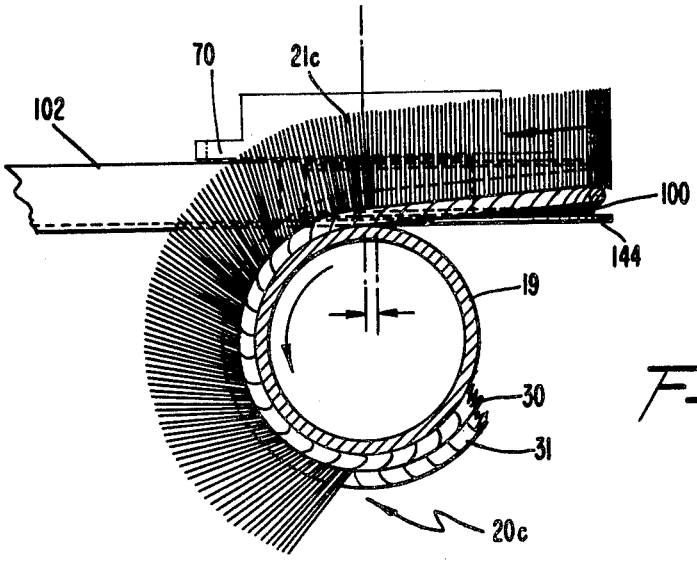
Fig. 10c

METHOD AND APPARATUS FOR MAKING WOUND BRUSHES

This is a division, of application Ser. No. 736,483, filed Oct. 28, 1976.

This invention relates to wound rope or cord bound brushes, methods of and apparatus for forming same, and particularly to improvements upon Enchelmaier U.S. Pat. No. 2,701,739, Feb. 8, 1955, and Enchelmaier et al U.S. Pat. No. 3,246,931, Apr. 19, 1966. In the embodiments of the apparatus of the present invention shown herein, the brushes produced are those which are sometimes referred to as "Fineset" brushes, wherein the bristles stand in even helical rows about the brush core.

Each of the bristles is in the form of a single substantially straight length of strand extending only from its inner, root end near the core to its outer end disposed radially outwardly of the core. All of the bristles in zones of substantial length axially in the brush core (said zones extending circumferentially of the brush, extend at substantially the same substantial angle with respect to radii of the core.

The bristles are held between the convolutions of one or more bristle-holding strands of cord, or the like helically wound on the brush core. A picker or bristle-feeding wheel, positioned with its axis generally normal to the axis of the brush core, is stationed so that the rim of one part of the wheel lies in a plane which is generally tangential to the cord being wound on the brush core in the portion thereof first entering upon or engaging the brush core, another portion of the wheel feeding bristles continuously between such entering cord portion and the last laid complete convolution of cord on the core. The cords and bristle roots are bonded to the brush core by an adhesive with which the cords are impregnated on their way to the brush core and, alternatively, additionally by further adhesive supplied to the zone of the first engagement of the cords and bristle roots with the brush core.

In the prior art, as typified in the above-referred to Enchelmaier U.S. Pat. No. 2,701,739, it was possible only to produce brushes of the type described in which the bristles extend in longitudinal planes extending radially of the axis of the brush core. In accordance with the present invention, however, by simple adjustment of the parts of the brush-making machine, it is possible not only to make brushes in which the bristles extend radially of the axis of the brush core but also selectively to produce novel brushes in which the bristles either (1) incline forwardly in the direction of rotation of the brush core or (2) incline rearwardly with respect to the direction of rotation of the brush core. Brushes of the above two types are of marked advantage in the treatment, for example, of certain types of cloth. Further, brushes may be produced in which one or more selected portions thereof have the bristles disposed as in brush 1 and in other portions of the brush the bristles may be disposed either radially of the axis of the core or in accordance with brush 2, above.

In accordance with the apparatus of the present invention, the picker or bristle-feeding wheel is driven at a selected angular speed which is synchronized with the angular speed of rotation of the brush core. The bristle-holding cord or cords are guided to the point of initial application of the bristles to the brush core over an idle cord-guide roller, such roller being mounted upon a guide plate which is adjustable toward and away from the vertical longitudinal plane containing the axis of the brush core. By a suitable adjustment of the guide plate, and thus of the cord-guiding roller which is freely rotatable thereon, the axis of the bristles of the brush may be made (1) to incline forwardly with respect to the direction of the rotation of the brush core, (2) to retreat from the direction of the rotation of the brush core, or (3) to extend radially with respect to the surface of the brush core.

Briefly, in the disclosed embodiment the picker wheel is disposed in a horizontal plane and rotates at a uniform speed. The bristles approach the picker wheel at a constant speed and are forwarded by it in a horizontal direction to the zone of their initial engagement with the brush core. The brush core is rotated at a uniform speed; the ropes or cords approach the brush core in a horizontal direction and at a uniform speed, since they are being wound on the brush core.

If the roots of the bristles are first effectively engaged between sets of turns of the cords or ropes in the vertical longitudinal plane through the axis of the brush core, the bristles in the finished brush will extend radially from the core. If, however, the ropes first effectively engage the cords before dead center, that is, the vertical longitudinal plane through the axis of the brush core, the bristles will lean forward at an angle $\alpha^1$ with respect to the direction of rotation of the brush core. If the cords or ropes first effectively engage the bristle roots after dead center, the bristles incline rearwardly at an angle $\alpha^2$ with respect to the direction of travel of the brush core.

In a further embodiment of the apparatus brushes are produced wherein the bristles are disposed radially of the core axis, but are disposed at an angle $\beta^1$ (in one axial direction) or $\beta^2$ (in the other axial direction) with respect to the transverse planes through the brush. This is accomplished by giving the inner surface of the guide plate, which the cords or ropes last engage before entering upon the brush core, an inclination in the proper direction with respect to the vertical. In accordance with this embodiment of the invention, brushes can also be made wherein the bristles incline in one axial direction at one end half of the brush and the other axial direction on the other end thereof by changing the rope guide plate midway of the length of the brush during its formation or one with a terminal guide surface inclined in the other direction. As indicated above, such last brush may be employed, for example, to smooth cloth passing the brush and engaged thereby, since the bristles will then impel the opposite longitudinal edges of the cloth away from each other.

Finally, the machine of the invention can incorporate the above described features which selectively permit variation of both angled $\alpha^1(\alpha^2)$ and angle $\beta^1$ or $\beta^2$, so that a brush produced by it will have both of such angles $\alpha^1$ or $\alpha^2$ and $\beta^1$ or $\beta^2$ with values different from 0.

In the embodiments of the apparatus of the invention first disclosed herein the adhesive required to bond the cords or ropes to the bristles and the combination of bristles and cords to the core is supplied by dipping the cords in such adhesive prior to their travel to the brush core. In some instances, however, such adhesive is insufficient to produce the desired strength of bond between bristles, cord and brush core. Thus, in accordance with the last disclosed embodiment of the apparatus here, there is employed, in addition to means for the impregnation of the cords by immersing them in adhesive, a selectively operated adhesive pump which delivers adhesive to the cords and bristle roots entering into initial engagement with the brush core thus to supplement as required the supply of adhesive applied to the cords and the bristle roots.

The above and further objects and novel features of the invention will more fully appear from the following description when the same is read in connection with the accompanying drawings. It is to be understood, however, that the drawings are for the purpose of illustration only, and are not intended as a definition of the limits of the invention.

In the drawings, wherein like reference characters refer to like parts throughout the several views:

FIG. 4 is a view in plan of the adjustable plate which mounts the wheel for guiding the cords upon the core of the brush;

FIG. 5 is a view in side elevation of the guide plate of FIG. 4;

FIG. 6 is a fragmentary view in plan on an enlarged scale of the right-hand and of the adjustable guide plate as it is shown in FIG. 4 with the cord guiding roller in place;

FIG. 7 is a view in diametral section through the cord guiding roll;

Figure 1:
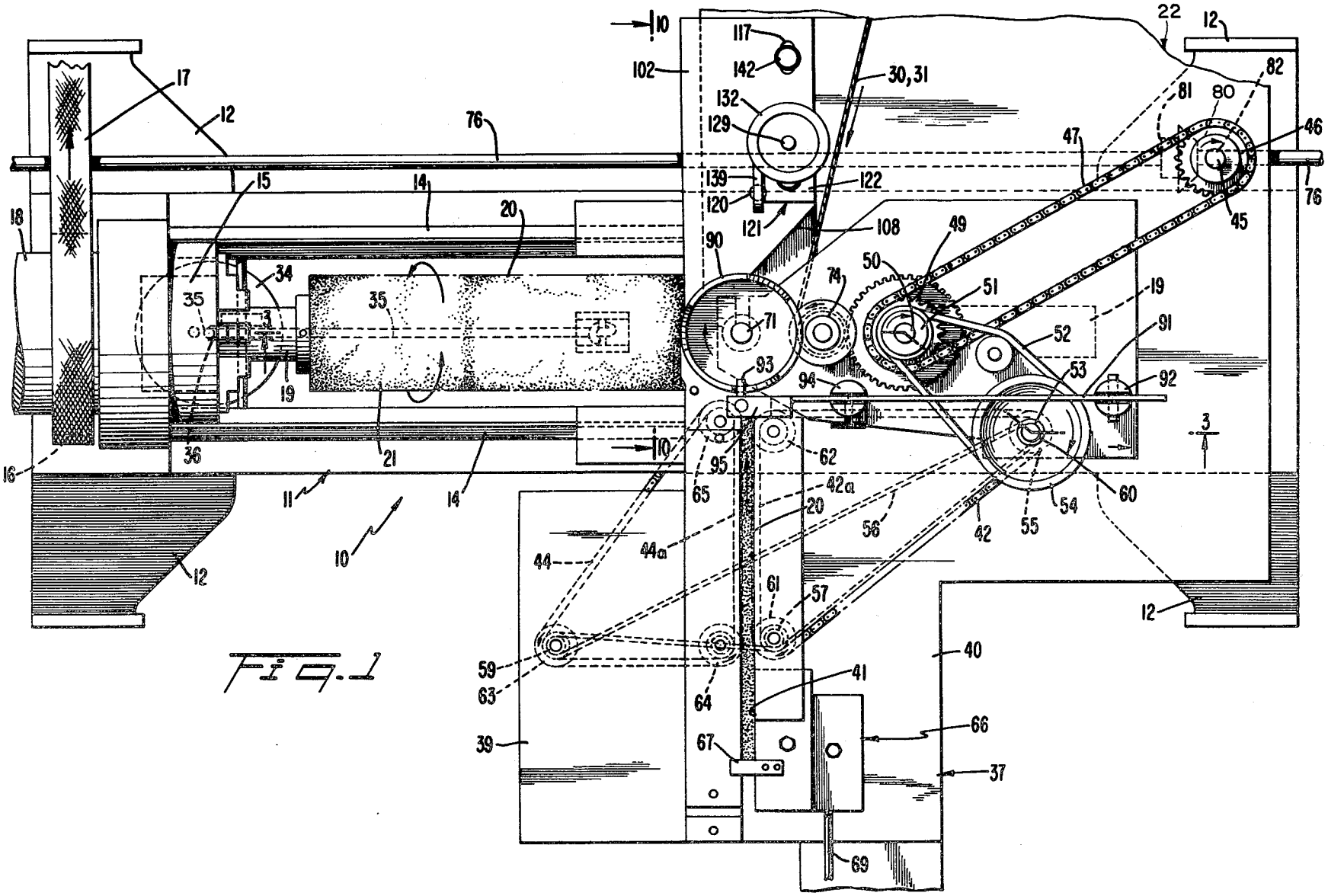
FIG. 1 is a fragmentary view in plan of brush making apparatus in accordance with the invention.
Figure 11:
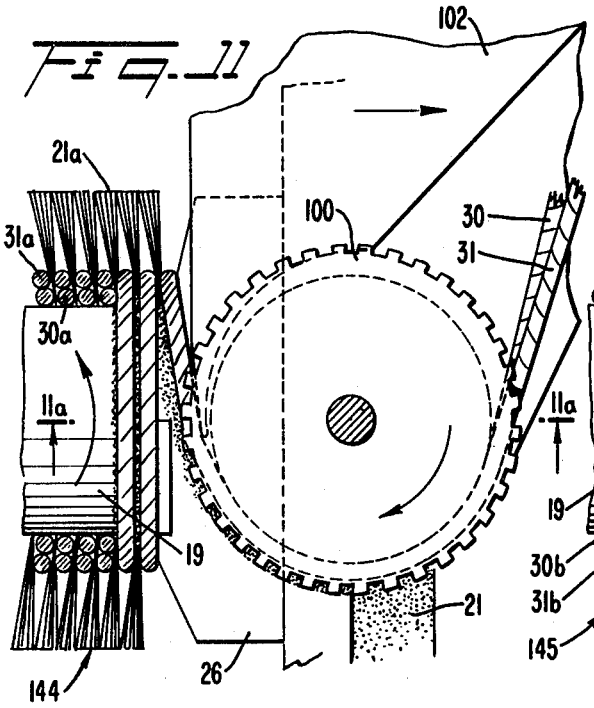

FIG. 10*a* is a fragmentary view in cross section taken along line 10—10 in FIG. 1 with the adjustable cord guiding plate disposed as in FIG. 1 so as to produce a brush in which the bristles are disposed radially of the brush core;

FIG. 10*b* is a view similar to FIG. 10*a* but with the cord-guiding plate moved somewhat to the left of its position in FIG. 10*a*, so as to produce a brush wherein the bristles are disposed so as to lie inclined in a direction radially outwardly and forwardly with respect to the direction of rotation of the brush, that is, the bristles have a positive angle of attack;

FIG. 10*c* is a view similar to FIGS. 10*a* and 10*b* but with the cord-guiding plate disposed somewhat to the right of the position thereof which is shown in FIG. 10*a* so as to produce a brush in which the bristles are inclined in a direction opposite from that of FIG. 10*b* with respect to radial axial planes through the brush core, that is, have a negative angle of attack;

FIG. 11 is a fragmentary view in plan of the portion of the brush-making machine at the location wherein the bristles and the cords are laid upon the brush core, the machine being here shown modified to produce a brush wherein the bristles are inclined to the left in the radially outward direction with respect to transverse planes through the axis of the brush core.

Figure 12:
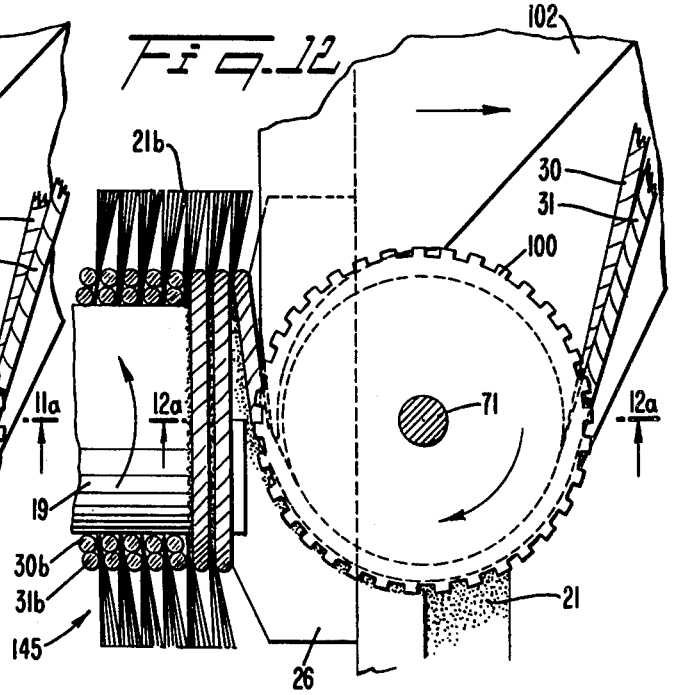
Figure 11A:
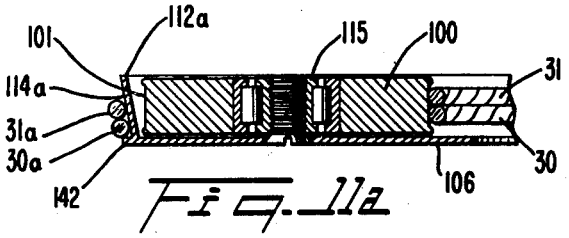

FIG. 11*a* is a view in vertical section through the cord-feeding portion of the machine shown in FIG. 11, the section being taken along the line 11*a*—11*a* in FIG. 11;

FIG. 12 is a view similar to FIG. 11 but of a second modification of the machine, such apparatus producing a brush wherein the bristles are disposed in a radially outward direction which is opposite from that shown in FIGS. 11 and 11*a;*

Figure 12A:
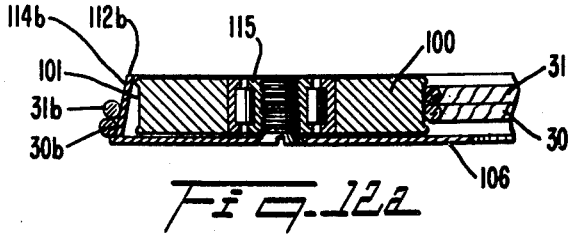
Figure 13:
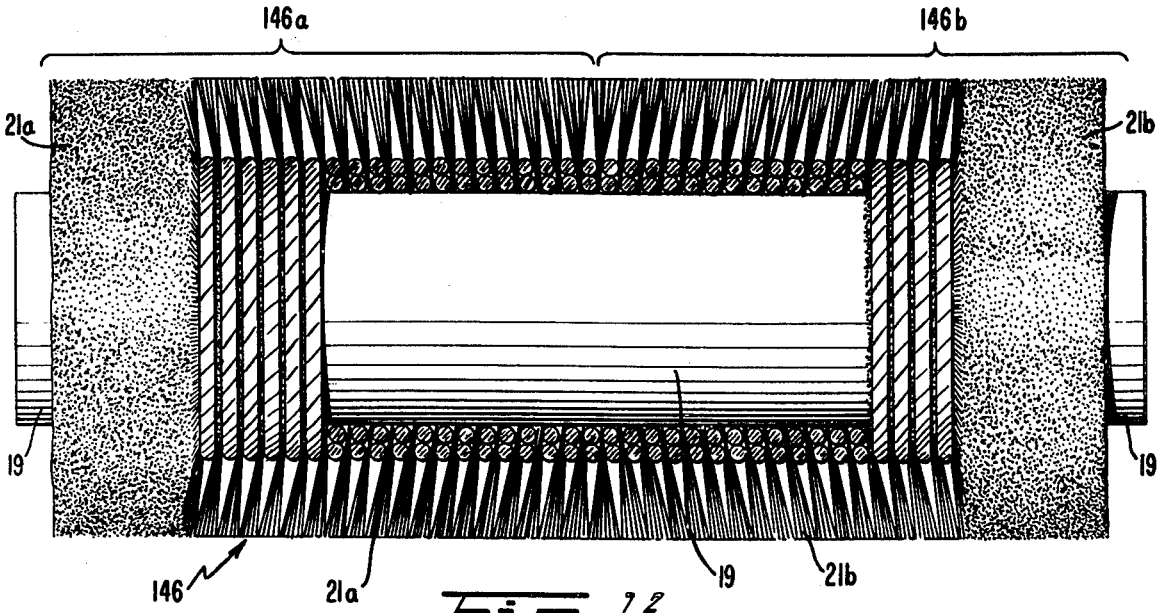

FIG. 12*a* is a fragmentary view in vertical cross section through the cord feeding portion of the apparatus of FIG. 12, the section being taken along the line 12*a*—12*a* in FIG. 12;

FIG. 13 is a view partially in side elevation and partially in vertical axial section through a cord bound brush wherein the bristles in the left-hand half thereof are disposed as in FIGS. 11 and 11*a* and the bristles in the right-hand half thereof are disposed as in FIGS. 12 and 12*a;*

Figures 14, 15:
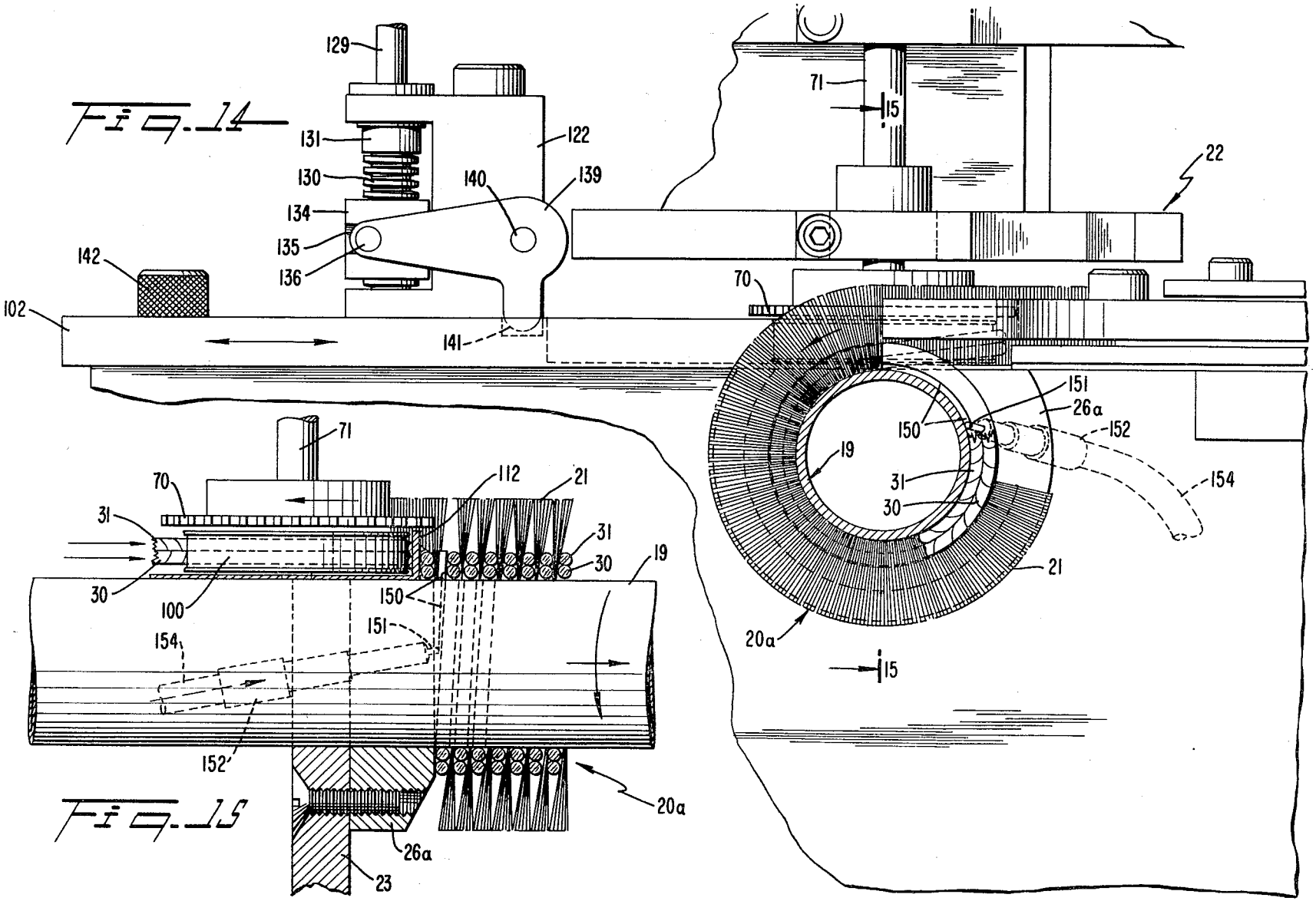
Figure 16:
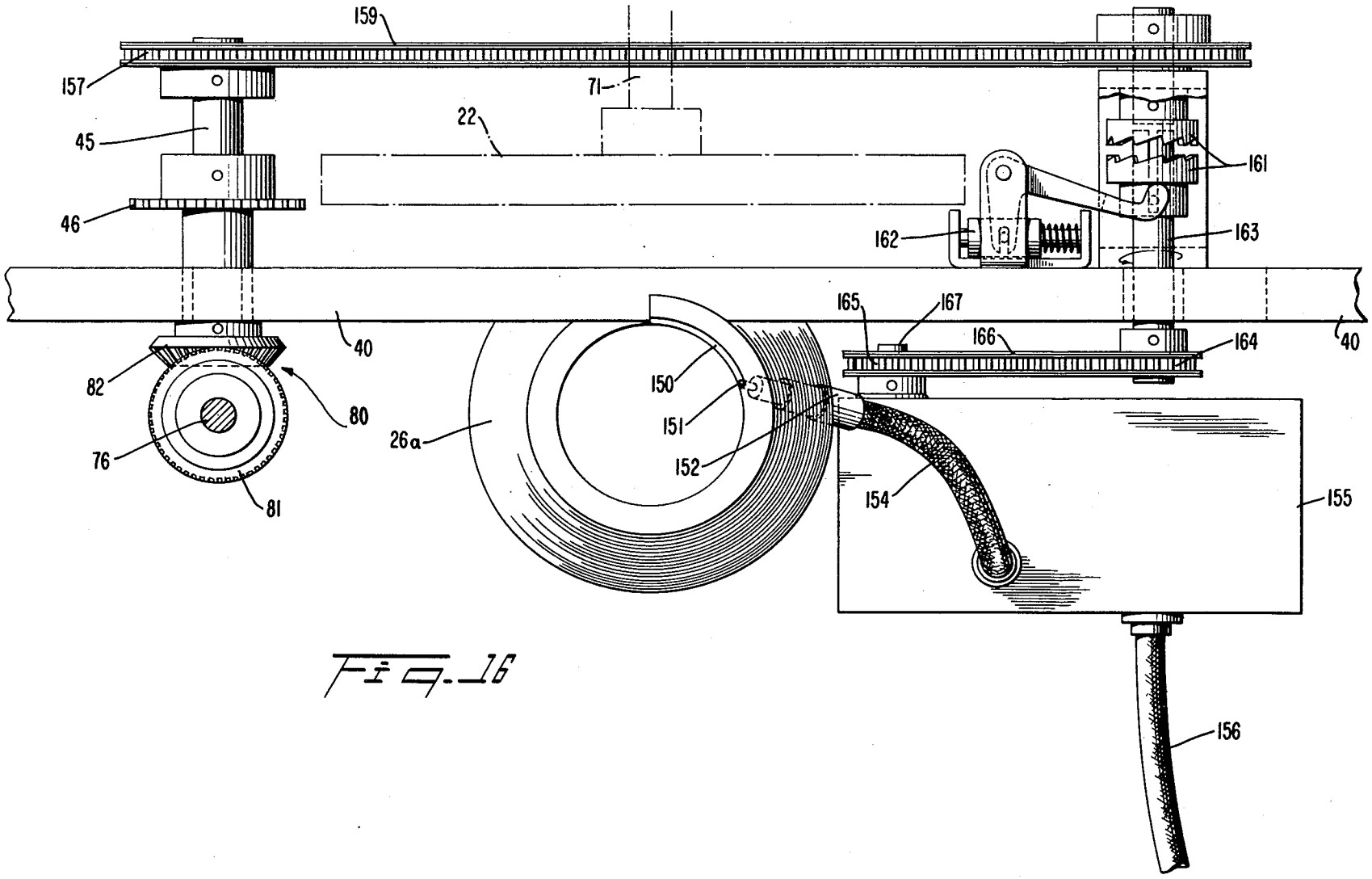

FIG. 14 is a fragmentary view partially in vertical transverse section and partially in end elevation of a further modification of the apparatus, such apparatus incorporating means for supplying adhesive to the bristle and cord-laying zone which is additional to that supplied by the dipping of the cords in adhesive prior to the laying of them upon the brush core;

FIG. 15 is a view partially in vertical section and partially in elevation of the apparatus of FIG. 14, the section being taken generally along the line 15 — 15 in FIG. 14; and FIG. 16 is a schematic view of an adhesive pump and mechanism for selectively driving it.

GENERAL ORGANIZATION

Figure 2:
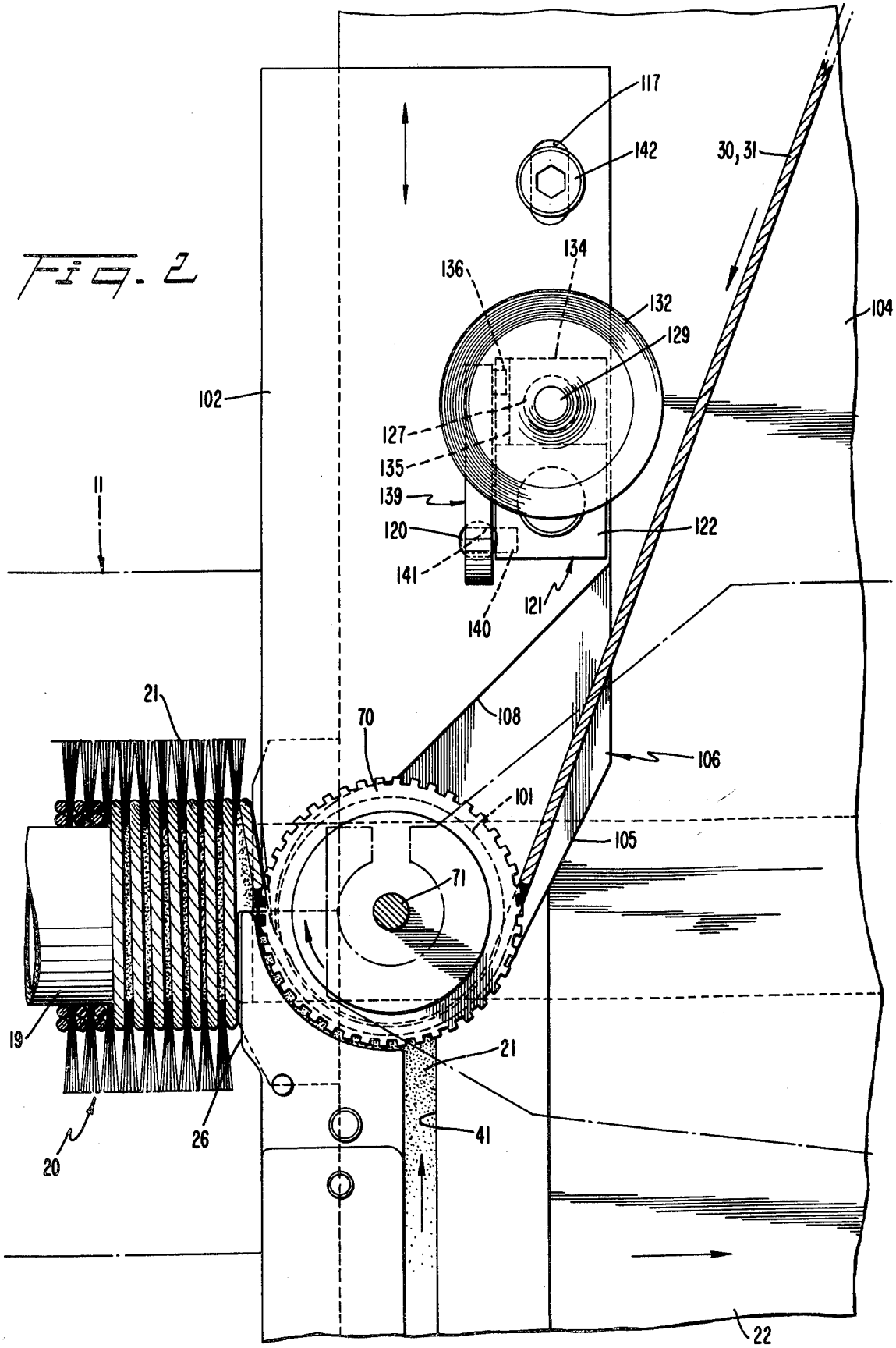
FIG. 2 is a view in plan on an enlarged scale of the portion of the apparatus of FIG. 1 which includes the several parts of the apparatus for laying the bristles and the bristle-securing cords upon the core of the brush.
Figure 3:
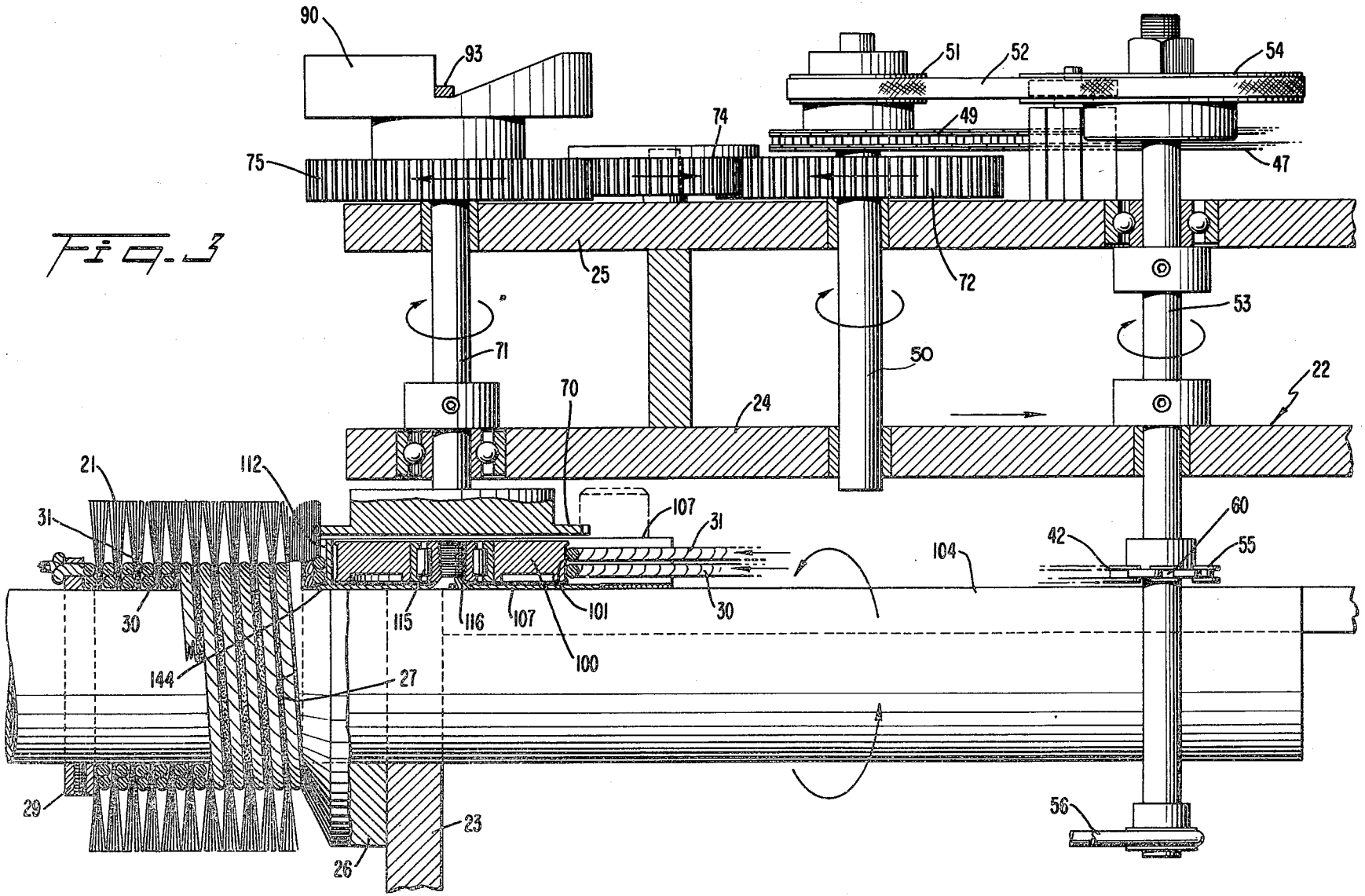
FIG. 3 is a fragmentary view in vertical longitudinal section through the apparatus of FIG. 1, the section being taken along the broken line 3—3 in FIG. 1.

Turning first to the embodiment shown in FIGS. 1–10, inclusive, and particularly to FIGS. 1, 2 and 3 which show the general organization of the machine, the brush-making machine generally designated 10, which generally resembles a lathe, has a horizontal bed 11 which is supported on legs 12. Parallel ways 14 extend longitudinally of the bed, at the left-hand end of the ways there being a head stock in which there revolves a driven shaft 18 bearing a chuck 15 on its inner, right-hand end and a driving pulley 16 on its outer, left-hand end. The pulley 16 is driven by a belt 17 which is entrained over a pulley affixed to a driving means, such as a geared electric motor (not shown). The brush core 19, in the form of a tube, is gripped and guided by the chuck 15 at its left-hand end and is guided in a stepped, helically faced bushing 26 on a carriage 22 which moves longitudinally of the ways 14 of the machine as the brush 20*a* is progressively formed by having bristles 21 and bristle-retaining cords 30, 31 continuously fed thereto.

The carriage 22 has a vertical plate 23 affixed to the left-hand thereof, the helical bushing 26 being secured to the vertical plate 23 at an aperture therethrough. As shown in FIG. 3, the carriage 22 also includes an intermediate horizontal plate 24, an upper horizontal plate 25 spaced from plate 24, and a lower horizontal plate 104 spaced beneath intermediate plate 24.

At the start of the formation of a brush, the cords 30, 31 are secured to a starting collar 29 on the brush core 19, the chuck 15 and the brush core 19 are rotated upon putting the machine in operation, the cords 30, 31 being presented to the left-hand helical face 27 of the helical bushing 26 as a row of bristles is progressively fed between a previously wound convolution of the cords and the next such convolution thereof. The carriage 22 is constantly urged in the direction from right to left, so as to compact the cords and bristles as they are introduced upon the brush core, by a hanging weight 34 which is connected to the carriage 22 by a cord 35 which runs over an idle guiding pulley 36 rotatably mounted upon the bed of the machine 10.

The Bristle Feed

The means for feeding the bristles to the brush core generally resembles that shown in Enchelmaier et al U.S. Pat. No. 3,246,931. However, for completeness, such means is here generally described. The carriage 22 has a forward portion generally designated 37, an elongated left-hand portion generally designated 39, and an elongated right-hand portion generally designated 40, all of such parts having upper horizontal plate-like members, between parts 39 and 40 there is formed a parallel sided bristle guiding groove 41 which is disposed generally axially of the picker or bristle-feeding wheel 70. Driven bristle feeding chains 42 and 44 having opposing parallel runs 42*a* and 44*a*, respectively, disposed on opposite sides of the groove 41 forward the bristles in upright position toward the brush core as the machine operates.

As shown in FIGS. 1 and 3, a drive shaft 45, driven in the manner more particularly shown in FIG. 8 to be described hereinafter, has a sprocket 46 affixed thereto about which there is entrained a driving chain 47 which also passes about a driven sprocket 49 affixed to a vertical shaft 50 parallel to shaft 45. Also affixed to shaft 50 there is a driving V-pulley 51 about which there passes a V-belt 52, belt 52 also passing about is driving a large pulley 54 which is affixed to a vertical shaft 53. A V-belt 56 passes about a V small pulley 55 affixed to shaft 53, about a first, idle guide pulley 57, then reversely about a second, idle guide pulley 59, from which it returns to the pulley 55. A sprocket 60 is affixed to shaft 53. The above mentioned bristle-feeding chain 52 passes about sprocket 60 and thence about an idle sprocket 61 disposed at the right-hand side of the bristle feeding grove 41 from which it travels inwardly toward the bigger wheel and brush core to a second idle sprocket 62, the span of the chain 42 between the sprockets 61 and 62 following the above described run 42*a* of such chain. The other bristle-feeding chain 44 is driven by a sprocket 63 affixed to the pulley 59, the chain 44 being guided in its run 44*a* by idle sprockets 64 and 65 which are disposed opposite the sprockets 61 and 62 for the chain 42.

It will thus be seen that shaft 45, which is driven in synchronism with the shaft 18, drives the bristle-feeding chains 42, 44 to feed bristles to the picker wheel in synchronism with the rotation of the core of the brush being formed.

Bristles are supplied to the bristle-feeding groove 41 in a manner similar to that disclosed in Enchelmaier U.S. Pat. No. 2,701,739. A bristle-feeding slide 66 which is manually reciprocated toward and away from the brush core carries a finger 67 which overlies the bristle-feeding groove or slot 41. A handle 69 extends rearwardly from the slide 66 to permit the operator to retract the slide. Means (not shown) such as a freely hanging weight constantly urges the slide 66 in a direction toward the brush core thereby constantly to maintain the desired feeding thrust upon the row of bristles in the groove 41.

As is particularly shown in FIG. 3, the serrated picker wheel 70 feeding the bristles is mounted on the lower end of the vertical shaft 71. Shaft 71 is driven by the shaft 45 through the medium of the above described sprocket 46. chain 47, and sprocket 49 which thus drives the shaft 50. A spur gear 72 is affixed to shaft 50, such gear meshing with an idle intermediate gear 74, which in turn meshes with a gear 75 affixed to the shaft 71 adjacent its upper end.

The Drive for Shaft 45

Figure 8:
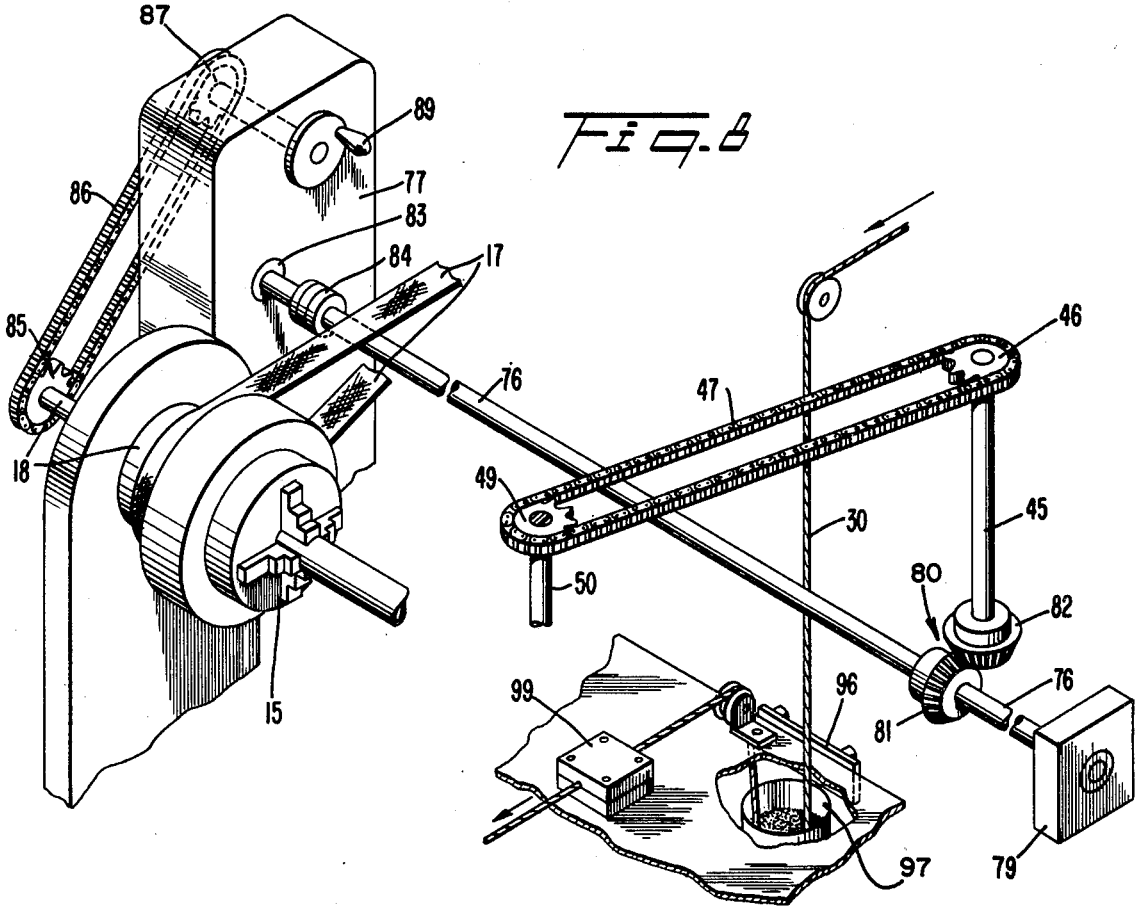
FIG. 8 is a fragmentary view in perspective of the portion of the brush making machine of the invention including means for driving the core of the brush being made and the means for feeding the bristles and the cords to the brush core, a single bristle binding cord being shown for simplicity of illustration.

Turning now to FIG. 8, it will be seen that the illustrative embodiment of the machine is provided with counter shaft 76 which extends parallel to the ways 14 of the machine, and that the countershaft 76 is driven by a positive infinitely variable speed gearing (PIV) 77. The outboard end of the countershaft 76 is supported in a bearing 79, the inboard end of such shaft being connected and supported by a coupling 84 which connects it to the outboard shaft 83 of the gearing unit 77. As shown in FIG. 1, a bevel gear set 80, mounted upon the carriage 22 to move longitudinally therewith, has a first gear 31 mounted upon and keyed to the countershaft 76 and a second bevel gear 82 which is fixedly connected to the vertical shaft 45. The change speed gearing unit 77 is driven from the shaft 18 of the machine, there being a first sprocket 85 connected to such shaft and the sprocket 87 on the input drive shaft of the variable speed unit, such two sprockets being drivingly connected by a chain 86. The ratio of the angular speeds between the shaft 18 and 76 may be varied by turning a speed control wheel 89 on the unit 77. It is to be understood that the shaft 45 may be driven in other known manners whereby to maintain synchronism between the shafts 18 and 76 while preserving a predetermined desired speed ratio between them.

The Bristle Tamper

The machine is provided with means which tamps the bristles in the slot 41 as they approach the picker wheel 70 downwardly so that their lower ends engage the horizontal plate of the carriage 22 underlying such groove 41, in order that the bristles when presented to the brush core by the picker wheel all have their lower ends engaging the outer surface of the core. As shown most clearly in FIG. 3, a face cam 90 having two oppositely disposed sharp drop-offs each followed by a ramp (FIG. 1) is affixed to the upper end of the vertical shaft 71. A lever 91 having a cam follower 93 at its left-hand end (FIG. 1.) is pivoted at 92, is guided in its oscillating vertical movement by a slotted upstanding guide member 94. A tamping shoe 95 is affixed to the lefthand end of the lever 91 above the cam follower 93, the tamping shoe overlying the lateral inner end of the bristle feeding groove 41. The lateral dimension of the tamping shoe 95 is such that the upper ends of all of the bristles are engaged by it at least once as such bristles travel to the picker wheel.

The Cord Treatment and Manipulation

The two cords 30, 31 after being withdrawn from appropriate sources (not shown) pass in side-by-side relationship through a core retarder or brake 96 which includes two jaws between which the cords pass, one of the jaws being pressed thereagainst as by springs (not shown). Thereafter the cords pass downwardly about guiding pulleys into a pot 97 which contains liquid adhesive so that the cords are impregnated therewith. Upon rising from the pot 97 the cords then pass through a cord squeegee 99 so as to remove excess adhesive from them.

The Cord and Bristle Guiding Means

After leaving the cord squeegee 99, the cords 30, 31 pass with cord 31 above cord 30 about an idle cord guiding wheel 100 which has a circular cylindrical guiding surface 101 and shallow rims on the opposite ends of such surface. The guide wheel 100, which has at its upper end spaced from the lower end of the picker wheel 70 as shown in FIG. 3, is mounted for free rotation upon a guide plate 102 which lies upon and is adjustable with respect to the lowermost horizontal plate 104 of the carriage 22. The configuration of plate 102 and the relationship of the cord guiding wheel 100 with respect thereto will be more readily understood upon consideration of FIGS. 4–7, inclusive.

In its left-hand end portion which extends somewhat to the right of its longitudinal center (FIG. 4) the plate 102 is of rectangular shape. In its upper right-hand corner (FIG. 4) the plate 102 has an edge 105 which inclines upwardly and to the left, the lower portion of such inclined edge merging smoothly with a part-circular right-hand edge 111 which extends downwardly generally to merge with the lower straight edge of the plate 102. The right-hand portion of the plate 102 contains an upwardly open seat 106 having a thin lower wall 107, the left-hand boundary of such seat being formed by an upright shoulder 108 which inclines upwardly and to the left in FIG. 4 and an arcuate shoulder 109 which decreases in radius in a counterclockwise direction. As can be seen in FIG. 6, the cord guiding wheel 100 is mounted coaxial of the surface 111, the gap between the periphery of wheel 100 and shoulder 109 gradually decreasing in a counter-clockwise direction.

As shown in FIG. 2, the cords 30, 31 in approaching the picker wheel 70 first enter the straight walled portion of the seat 106, travel counterclockwise about the guide wheel 100 and then pass over the outer surface 114 of a guide finger 112 which is formed as an integral part of the arcuate shoulder 109. The surface 114, which in the embodiment of FIGS. 4–7, inclusive, lies in a plane normal to the paper, is inclined at the small angle, for example, five degrees as shown, downwardly and the left (FIG. 4). Immediately after leaving the surface 114 the cords 30, 31 engage the helical surface 27 of the bushing 26 and thence travel to the brush core.

The cord guiding finger or projection 112 has the right-hand outer end thereof disposed somewhat radially inwardly of the surface 111, as shown in FIG. 4, thereby to expose a zone 113 of the thin plate portion 107 so as to provide a support for the radially inner cord 30 as it passes over the guiding surface 114 on its way to the helical guiding surface of the bushing 26. As shown in FIGS. 3 and 7, the cord guiding wheel 100 is mounted upon a roller bearing 115 the inner race of which is secured to the thin lower plate part 107 of the guide plate 102 by a machine screw 116.

Figure 9:
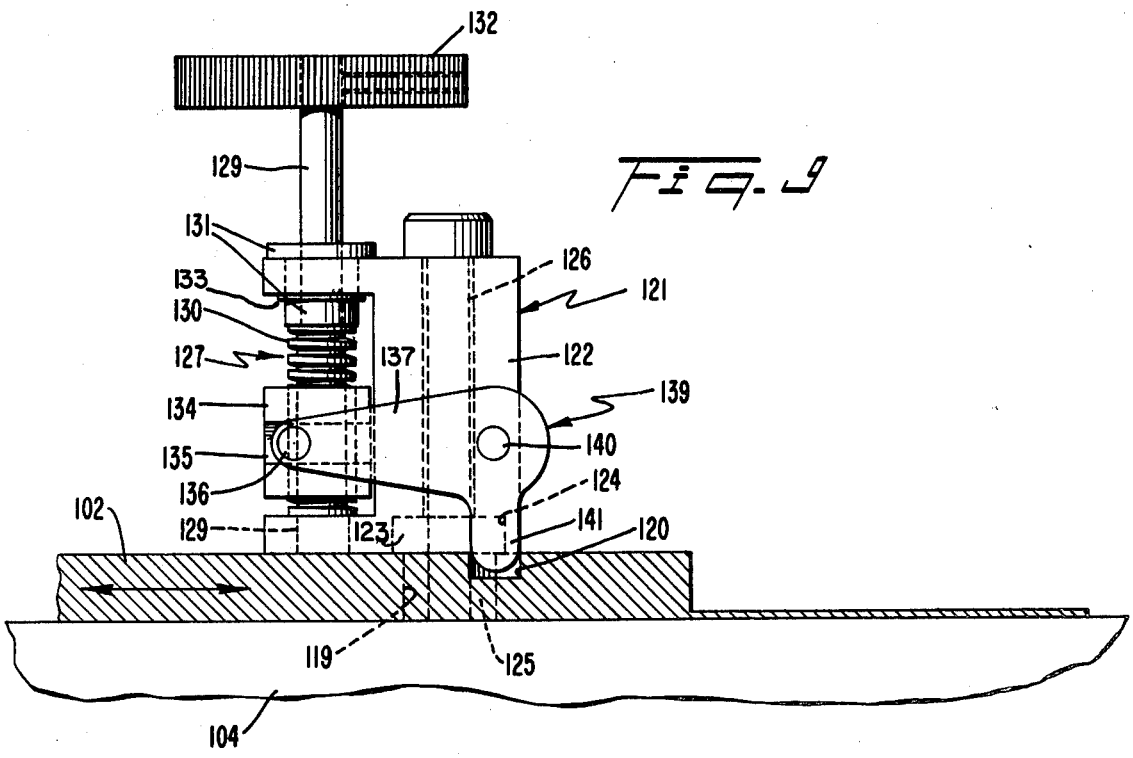
FIG. 9 is a view in side elevation of the combination of the adjustable guide plate, the means for adjusting the guide plate, and a portion of the longitudinally movable carriage of the machine upon which the guide plate and the plate adjusting means are mounted.

Again referring to FIG. 4, the guide plate 102 is provided with longitudinally spaced aligned left and right slots 117 and 119, and with a circular recess 120 disposed somewhat below and to the right (FIG. 4) of the slot 119. The guide plate 102 is adjustably secured to the plate 104 of the carriage 22 by a machine screw 142 which extends through the slot 117 (FIG. 2) and by a long machine screw 126 which extends through the slot 119 (FIG. 9). The guide plate 102 is adjusted in the direction of the lengths of the slots 117, 119 by a finger 141 which is received in the recess 120 and is selectively swung in a plane parallel to the lengths of the slots 117, 119. Finger 141 forms a part of a plate adjusting mechanism shown in FIG. 9.

The Cord Guide Plate Adjusting Mechanism

The cord guide plate adjusting mechanism (FIG. 9), which is generally designated 121, has a C-frame 122 which is disposed above the guide plate 102. A bushing 125 having a main portion which accurately fits between the elongated sides of the slot 119 has a flange 123 at its upper end overlying the sides of such slot in plate 102. The base of the frame 122 of the adjuster 121 has a recess or seat 124 therein which receives the flange 125 of the bushing. When the plate 102 is to be adjusted, the machine screws 126 and 142 are loosened, the adjuster is then operated, following which the screws 126 and 142 are tightened.

Between the parallel arms of the frame 122 there extends a vertical rotatable screw 127 which is journaled in such upper and lower arm by having a pilot portion 129 at the lower end of the screw received in a bearing in the lower arm, and the upper, unthreaded portion of the screw received in a bushing in the upper arm and restrained from axial movement by the flange on the upper end of a bushing 131 which overlies the upper arm of the frame, such bushing being fixed to the upper unthreaded portion 129 of the screw and being restrained from upward movement by a locking ring 133 snapped thereon beneath the upper arm.

A handwheel 132 is affixed to the upper end of the screw. A nut 134 is disposed on the threaded portion 130 of the screw. The nut has a horizontal groove 135 along one side thereof, such groove accurately receiving a pin 136 which is mounted on a first, longer arm 137 of a bell crank 139 which is pivotally supported upon a side of the frame 122 by a stub shaft 140. The second, lower arm 141 of the bell crank 139, which is circular in horizontal section, is accurately received within the recess 120 in the upper surface of the cord guide plate 102. Turning of the handwheel 132 in opposite directions adjusts the plate 102 in a respective direction along its greater dimension, and thus adjusts the cord guiding wheel 100 with respect to the vertical axial plane of the brush core.

The Brushes of FIGS. 10*a–c*

FIGS. 10*a–c* illustrate three different brushes which may be produced by selective adjustment of the cord guiding plate 102 of the machine. Such brushes are designated, respectively, 20*a*, 20*b* and 20*c*.

Brush 20*a* has the bristles thereof extending radially of the brush core. When the machine is adjusted to produce 20*a*, the axes of the picker wheel 70 and the cord guiding wheel 100 are disposed in alignment.

The brush 20*b*, in which the bristles have a positive angle of attack, is produced when the cord guide plate 102 is adjusted so that the axis of the cord guide wheel 100 lies somewhat to the left of the axis of the picker wheel and thus the axis of the brush core 19.

The brush 20*c*, wherein the bristles have a negative angle of attack, is produced when the cord guide plate 102 is adjusted so that the axis of the cord guiding wheel 100 lies somewhat to the right of the axis of the picker wheel 70 and thus to the right of the vertical longitudinal plane containing the axis of the brush core 19.

The Brushes of FIGS. 11–13

In the machine as described above the bristles lie in planes transverse to the axis of the brush core. The machine may be modified, however, as shown in FIGS. 11 and 12 to produce brushes wherein the bristles are inclined in a direction radially outwardly and to the left (FIG. 11) or radially outwardly to the right (FIG. 12). This modification may be applied to the machine with the guide plate 102 selectively adjusted as above described to produce any of (*a*) the brush which in transverse section appears as in FIG. 10*a*, (*b*) the brush which in transverse section appears as in FIG. 10*b*, and (*c*) the brush which in transverse section appears as in FIG. 10*c*.

In the machine of FIGS. 11 and 11*a* the parts are the same as those described in connection with FIGS. 1–10, inclusive, with the exception that the guide finger for the cords, there designated 112*a*, inclines upwardly and radially outwardly of the cord guiding wheel 100 (FIG. 11*a*) so that the cord guiding surface 114*a* causes the radially outer cord 31*a* to lie somewhat to the left of the corresponding turn of the radially inner cord 30*a*.

In the machine of FIGS. 12 and 12*a*, on the other hand, as shown in FIG. 12*a* the guiding finger 112*b* is inclined in a direction axially upwardly and radially inwardly so that the guiding surface 114*b* causes each convolution of the radially outer cord 31*b* to lie somewhat to the right of the corresponding radially inner cord 30*b*. As can be seen in FIGS. 11 and 12 such inclinations of the corresponding convolutions of the outer and inner cords causes the bristles to assume a corresponding inclination with respect to the axis of the brush.

The brush 146 shown in FIG. 13 has the left-hand half 146*a* thereof with a construction such as that shown in FIGS. 11 and 11*a*, and the right-hand half 146*b* with a construction as shown in FIGS. 12 and 12*a*. This brush may be readily made by winding the left-hand end of the brush with the apparatus of FIGS. 11 and 11*a* following which the machine is stopped and a guiding plate 102 such as shown in FIGS. 12 and 12*a* is then substituted in the machine, whereupon winding of the brush is completed.

The Adhesive Feeding Means of FIGS. 14 and 15

In some instances the adhesive supplied to the bristle roots and the cords is insufficient to produce the desired strength of bond between bristles, cord and brush core. In FIGS. 14 and 15 there is disclosed an embodiment of the apparatus wherein there is employed in addition to the means for the impregnation of the cords by immersing them in adhesive, a selectively operated adjesive pump which delivers adhesive to the cords and bristle roots entering into initial engagement with the brush core to supplement as required the supply of adhesive applied to the cords and the bristle roots.

As shown in FIGS. 14 and 15 there is provided on the helical face of the bristle and cord laying bushing, there designated 26*a*, a shallow adhesive receiving groove or track 150 which extends over a part of the circumference of the bushing and lies immediately adjacent to the bore through the bushing. A small diametered passage 151 extends through the bushing 26*a* into communication with the starting of upstream end of the groove 150. An adhesive conducting fitting 152 is screwed into an opening in the bushing 26*a* communicating with the passage 151, there being a flexible conduit 154 connected to the fitting 152 and extending from a selectively driven adhesive pump 155.

As shown in FIG. 16, pump 155 is supplied by a conduit 156 which extends to an adhesive sump (not shown). The pump 155 is driven from the countershaft 76 in the following manner: a sprocket 157 which is journaled in the carriage 40 and is traversed therewith along the length of the countershaft is connected by drive chain 159 to a driven sprocket on a drive shaft 163. Interposed in driveshaft 163 is a coupling 161 which is selectively coupled and uncoupled by manipulation of a control means 162 therefor. Beyond the coupling 161 there is mounted a first sprocket 164 on the shaft 163, sprocket 164 being drivingly connected to a second sprocket 165 on the drive shaft 167 of the adhesive pump by a chain 166.

Although the invention has been illustrated and described with reference to a limited number of preferred embodiments thereof, it is to be expressly understood that it is in no way limited to the disclosure of such preferred embodiments, but is capable of numerous modifications within the scope of the appended claims.

What is claimed is:

1. A machine for making a cord bound brush, comprising means for rotating a brush core, means for supplying cord for the formation of a helical coil on the brush core during its rotation, means for supplying bristles in a row substantailly tangentially to the core with their roots between the last complete turn of the coil of the cord and the portion of the cord at its first engagement with the core, means for guiding the cord as it approaches its first engagement with the core, and means for adjusting the cord guiding means in a plane normal to the axis of the brush core whereby to vary the inclination in said plane of the bristles at which they are engaged and held on the brush core by the cord.

2. The apparatus of claim 1, wherein the cord guiding means comprises an adjustable guide plate having a cord guiding portion.

3. The apparatus of claim 2, comprising means for supplying and guiding to the brush core at least two bristle-securing cords, the turns of one of said cords lying at least generally radially outwardly of the turns of the other of said cords, the cord engaging portion of the guide plate being engaged by said cords one above the other and guiding the cords in the plane at which they are presented to the brush core for being wound thereon.

4. The apparatus of claim 3, wherein the cord guiding portion of the guide plate is disposed in a plane generally normal to the axis of the brush core.

5. The apparatus of claim 3, wherein the cord guiding surface of the guide plate is disposed in a plane which lies at a substantial angle with respect to planes through the brush core normal to the axis thereof.

6. The apparatus of claim 1, wherein the cord guiding means comprises a freely rotating wheel.

7. The apparatus of claim 3, wherein the cord guiding wheel is journaled on the adjustable guide plate, said guide plate having a cord guiding portion over which the cord passes after it has left the cord guiding wheel.

8. The apparatus of claim 1, comprising a carriage mounted for movement along the brush core parallel to the axis thereof, a strand applying means mounted on the carriage, a wheel mounted on the carriage adjacent said last named means, means for rotating the wheel in synchronism with the brush core, said wheel having a bristle feeding periphery, means for supplying bristles to the bristle feeding periphery of the wheel, and means forming with the bristle feeding periphery of the wheel a bristle conducting passage extending from the bristle supplying means substantially directly to the brush core between the last complete turn of the coil of the cord and the portion of the cord at its first engagement with the core.

9. The apparatus of claim 1, wherein the axis of the bristle feeding wheel is disposed substantially radially of the brush core in a plane normal to the axis thereof, and the cord guiding means is adjustable through a range including the axis of the wheel.

10. The apparatus of claim 9, wherein the range of adjustment of the cord guiding means extends on both sides of the axis of the wheel.

11. A method of making a cord bound brush wherein the lengths of the bristles are disposed at a substantial angle with respect to radii of the core, comprising rotating a brush core, supplying cord for the formation of a helical coil on the brush core during its rotation, supplying bristles in a row substantially tangentially to the core with their roots between the last complete turn of the coil of the cord and the portion of the cord at its first engagement with the core, and engaging and holding the roots of the bristles between successive turns of the cord when the lengths of the bristles are disposed at a substantial angle with respect to radii of the core.

12. The method according to claim 11, wherein the bristles are engaged and held by the cord when they project outwardly from the core at a substantial angle with respect to axial radial planes through the core.

13. The method according to claim 12, wherein the bristles are engaged and held by the core when they also project outwardly from the core at a substantial angle with respect to planes through the core normal to the axis thereof.

14. The method according to claim 11, wherein the bristles are engaged and held by the cord when they project outwardly from the core at a substantial angle with respect to planes through the core normal to the axis thereof.

15. The method according to claim 14, comprising varying said angle whereby it is different at different zones along the length of the brush.

16. The method according to claim 14, wherein the bristles are engaged and held by the cord when they incline radially outwardly toward one end of the brush at at least one axial zone of the brush and the bristles incline radially outwardly toward the opposite ends of the brush at at least one other axial zone of the brush.

17. A method of making a cord bound brush, comprising rotating a brush core, supplying cord for the formation of a helical coil on the brush core during its rotation, supplying bristles in a row substantially tangentially to the core with their roots between the last complete turn of the coil of the cord and the portion of the cord at its first engagement with the core, adjustably guiding the cord as it approaches its first engagement with the core in a plane normal to the axis of the brush core whereby to vary the inclination in said plane of the bristles at which they are engaged and held on the brush core by the cord.

* * * * *